US012179960B2

(12) United States Patent
Lohrman et al.

(10) Patent No.: US 12,179,960 B2
(45) Date of Patent: Dec. 31, 2024

(54) TETHERED, HINGED CLOSURE

(71) Applicant: Silgan White Cap LLC, Downers Grove, IL (US)

(72) Inventors: Richard D. Lohrman, Montgomery, IL (US); Sungsuk Steve Kim, Batavia, IL (US); Gary L. Berge, Crystal Lake, IL (US); Dustin Vance, Lombard, IL (US); Darren R. Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 205 days.

(21) Appl. No.: 17/684,077

(22) Filed: Mar. 1, 2022

(65) Prior Publication Data

US 2022/0267065 A1 Aug. 25, 2022

Related U.S. Application Data

(63) Continuation of application No. PCT/US2020/049453, filed on Sep. 4, 2020.

(60) Provisional application No. 63/023,543, filed on May 12, 2020, provisional application No. 63/004,184, filed on Apr. 2, 2020, provisional application No. 62/900,917, filed on Sep. 16, 2019, provisional application No. 62/897,005, filed on Sep. 6, 2019.

(51) Int. Cl.
*B65D 41/34* (2006.01)
*B65D 55/16* (2006.01)

(52) U.S. Cl.
CPC ..... *B65D 41/3428* (2013.01); *B65D 41/3447* (2013.01); *B65D 55/16* (2013.01); *B65D 2401/30* (2020.05)

(58) Field of Classification Search
CPC ..... B65D 41/3428; B65D 41/3447; B65D 55/16; B65D 2401/30
USPC ..... 215/235
See application file for complete search history.

(56) References Cited

U.S. PATENT DOCUMENTS 2,990,077 A 6/1961 Van Baarn
3,335,889 A 8/1967 Brumme
(Continued)

FOREIGN PATENT DOCUMENTS

CA 2990674 9/2018
CN 1631740 6/2005
(Continued)

OTHER PUBLICATIONS

International Search Report and Written Opinion for International Application No. PCT/US2020/049493, dated Dec. 17, 2020, 13 pages.

(Continued)

*Primary Examiner* — Robert J Hicks
*Assistant Examiner* — Sanjidul Islam
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. The band remains coupled to the body of the closure even after being removed from a container.

17 Claims, 8 Drawing Sheets

FIG. 14

FIG. 15

(56) References Cited

U.S. PATENT DOCUMENTS

| | | | |
|---|---|---|---|
| 3,441,161 | A | 4/1969 | Van Baarn |
| 4,394,918 | A | 7/1983 | Grussen |
| 4,557,393 | A | 12/1985 | Boik |
| 4,565,295 | A | 1/1986 | Mori et al. |
| 4,666,053 | A | 5/1987 | Corcoran et al. |
| 4,805,792 | A | 2/1989 | Lecinski, Jr. |
| 5,215,204 | A | 6/1993 | Beck et al. |
| 5,295,600 | A | 3/1994 | Kowal |
| 5,360,126 | A | 11/1994 | Snyder et al. |
| 5,398,837 | A | 3/1995 | Degrassi |
| 5,676,269 | A | 10/1997 | Blake et al. |
| 5,725,115 | A | 3/1998 | Bosl et al. |
| 5,735,418 | A | 4/1998 | Erb et al. |
| 5,779,075 | A | 7/1998 | Salmon et al. |
| 5,853,095 | A | 12/1998 | Marshall et al. |
| 6,102,257 | A | 8/2000 | Goyet |
| 6,116,443 | A | 9/2000 | Parrinello |
| 6,372,167 | B1 | 4/2002 | Morini |
| 6,474,491 | B1 | 11/2002 | Benoit-Gonin et al. |
| 6,478,184 | B2 | 11/2002 | Berge et al. |
| 6,986,434 | B1 | 1/2006 | Getsy et al. |
| 7,314,150 | B2 | 1/2008 | Skillen |
| D593,856 | S | 6/2009 | Kubler |
| 7,712,618 | B2 | 5/2010 | Barre et al. |
| D648,215 | S | 11/2011 | Rigling et al. |
| 8,469,213 | B2 | 6/2013 | Ishii et al. |
| 8,490,805 | B2 | 7/2013 | Giraud et al. |
| 8,602,234 | B2 | 12/2013 | Hayashi |
| 8,695,822 | B2 | 4/2014 | Kwon |
| 8,720,716 | B2 | 5/2014 | Campbell |
| 9,010,555 | B2 | 4/2015 | Luzzato et al. |
| 9,108,774 | B2 | 8/2015 | Kwon |
| 9,376,243 | B2 | 6/2016 | Cerveny |
| 9,643,762 | B2 | 5/2017 | Maguire |
| 9,776,779 | B2 | 10/2017 | Campbell |
| 9,828,146 | B2 | 11/2017 | Maguire |
| 9,932,159 | B2 | 4/2018 | Maguire |
| 9,975,677 | B2 | 5/2018 | Maguire |
| 10,138,035 | B2 | 11/2018 | Loukov |
| 10,272,599 | B2 | 4/2019 | Cerveny |
| 10,518,942 | B2 | 12/2019 | Seibert et al. |
| 10,647,486 | B2 | 5/2020 | Maguire |
| 10,654,624 | B2 | 5/2020 | Sung |
| 10,654,625 | B2 | 5/2020 | Migas et al. |
| 10,836,549 | B2 | 11/2020 | Maguire |
| 10,981,700 | B2 | 4/2021 | Migas et al. |
| 11,040,806 | B2 | 6/2021 | Naumann et al. |
| 2003/0136783 | A1 | 7/2003 | Hatsumoto et al. |
| 2006/0049204 | A1 | 3/2006 | Seelhofer |
| 2006/0071000 | A1 | 4/2006 | Weist et al. |
| 2006/0163281 | A1 | 7/2006 | Weist |
| 2007/0151993 | A1 | 7/2007 | Yelland |
| 2008/0105640 | A1 | 5/2008 | Ott |
| 2008/0185384 | A1 | 8/2008 | Bolli |
| 2009/0236304 | A1 | 9/2009 | Watson |
| 2009/0302037 | A1 | 12/2009 | Rigling |
| 2010/0237073 | A1 | 9/2010 | Alther et al. |
| 2010/0326948 | A1 | 12/2010 | Campbell |
| 2011/0000871 | A1 | 1/2011 | Bernard et al. |
| 2011/0174760 | A1* | 7/2011 | Luzzato ..... B65D 41/48 215/258 |
| 2012/0024815 | A1 | 2/2012 | Kwon |
| 2012/0298666 | A1* | 11/2012 | Kwon ..... B29C 45/44 220/268 |
| 2013/0001184 | A1 | 1/2013 | Groubert |
| 2013/0001185 | A1 | 1/2013 | Antier et al. |
| 2015/0144630 | A1 | 5/2015 | Backes et al. |
| 2015/0259109 | A1 | 9/2015 | Vetten et al. |
| 2018/0118423 | A1 | 5/2018 | Bois et al. |
| 2018/0186505 | A1 | 7/2018 | Peterges et al. |
| 2018/0370701 | A1 | 12/2018 | Maguire |
| 2019/0071222 | A1 | 3/2019 | Druitt |
| 2019/0106246 | A1 | 4/2019 | Kendall |
| 2019/0344933 | A1 | 11/2019 | Kim |
| 2019/0344944 | A1 | 11/2019 | Maguire |
| 2019/0375555 | A1 | 12/2019 | Edie et al. |
| 2020/0017260 | A1 | 1/2020 | Migas et al. |
| 2020/0115115 | A1 | 4/2020 | Migas et al. |
| 2020/0207525 | A1 | 7/2020 | Sung |
| 2020/0369446 | A1 | 11/2020 | Melan-Moutet |
| 2020/0377259 | A1 | 12/2020 | Reisert et al. |
| 2020/0399036 | A1 | 12/2020 | Dai |
| 2020/0407124 | A1 | 12/2020 | Caszatt et al. |
| 2021/0039838 | A1 | 2/2021 | Hanan |
| 2021/0094733 | A1 | 4/2021 | Bloom et al. |
| 2021/0094736 | A1 | 4/2021 | Maguire |
| 2021/0179324 | A1 | 6/2021 | Hanan |
| 2021/0188488 | A1 | 6/2021 | Dreyer et al. |
| 2021/0221572 | A1 | 7/2021 | Migas |
| 2022/0002021 | A1 | 1/2022 | Krautkramer |

FOREIGN PATENT DOCUMENTS

| | | | |
|---|---|---|---|
| CN | 1631741 | | 6/2005 |
| CN | 1830730 | | 9/2006 |
| CN | 201209040 | | 3/2009 |
| CN | 102700822 | | 10/2012 |
| CN | 102700823 | | 10/2012 |
| DE | 9318243 | | 2/1994 |
| DE | 4123732 | | 8/1998 |
| DE | 102009010681 | | 2/2009 |
| DE | 202019106993 | | 1/2020 |
| DE | 202019106992 | | 2/2020 |
| DE | 102018128886 | | 7/2020 |
| DE | 102018130541 | | 7/2020 |
| DE | 102019132541 | | 11/2020 |
| DE | 102020107184 | | 5/2021 |
| DE | 102019132538 | | 6/2021 |
| DE | 202021103289 | | 8/2021 |
| EP | 1529736 | | 5/2005 |
| EP | 1961669 | | 8/2008 |
| EP | 3081505 | | 10/2016 |
| EP | 3135600 | | 3/2017 |
| EP | 3336003 | | 6/2018 |
| EP | 3584190 | | 12/2019 |
| EP | 3715275 | | 9/2020 |
| EP | 3715276 | | 9/2020 |
| EP | 3766797 | | 1/2021 |
| EP | 3798150 | | 3/2021 |
| EP | 3831736 | | 6/2021 |
| ES | 1266291 | | 4/2021 |
| FR | 2711969 | | 5/1995 |
| FR | 2953202 | | 6/2011 |
| FR | 3084881 | | 2/2020 |
| FR | 3093709 | | 9/2020 |
| JP | 11-500091 | | 1/1999 |
| JP | 2001019002 | | 1/2001 |
| JP | 2005041566 | | 7/2003 |
| JP | 2004307006 | | 11/2004 |
| JP | 2005289488 | | 10/2005 |
| JP | 4906441 | | 3/2008 |
| JP | 2011-201559 | | 10/2011 |
| JP | 2014061929 | * | 4/2014 |
| JP | 5520768 | | 6/2014 |
| JP | 5574582 | | 8/2014 |
| JP | 5600461 | | 10/2014 |
| KR | 20-0213792 | | 2/2001 |
| KR | 10-0855086 | | 8/2008 |
| KR | 20080093839 | | 10/2008 |
| KR | 10-0872159 | | 1/2009 |
| KR | 10-0942642 | | 2/2010 |
| KR | 10-0981240 | | 9/2010 |
| KR | 1017448460000 | | 6/2017 |
| MX | 2007015318 | A | 2/2008 |
| WO | WO94/14674 | | 7/1994 |
| WO | WO00/26108 | | 5/2000 |
| WO | WO2002/062674 | | 8/2002 |
| WO | WO2005/073098 | | 8/2005 |
| WO | WO2008/142413 | | 11/2008 |
| WO | WO2009/048273 | | 4/2009 |
| WO | WO2010/040961 | | 4/2010 |
| WO | WO2015/061834 | | 5/2015 |
| WO | WO2016/160591 | | 10/2016 |
| WO | WO2019/031779 | | 2/2019 |

(56) References Cited

FOREIGN PATENT DOCUMENTS

| | | |
|---|---|---|
| WO | WO2019/175740 | 9/2019 |
| WO | WO2019/177616 | 9/2019 |
| WO | WO2020/041640 | 2/2020 |
| WO | WO2020/050823 | 3/2020 |
| WO | WO2020/077162 | 4/2020 |
| WO | WO2020/093058 | 5/2020 |
| WO | WO2020/099516 | 5/2020 |
| WO | WO2020/156847 | 8/2020 |
| WO | WO2020/157695 | 8/2020 |
| WO | WO2020/182854 | 9/2020 |
| WO | WO2020/201227 | 10/2020 |
| WO | WO2020/212426 | 10/2020 |
| WO | WO2020/227813 | 11/2020 |
| WO | WO2021/005428 | 1/2021 |
| WO | WO2021/005505 | 1/2021 |
| WO | WO2021/013370 | 1/2021 |
| WO | WO2021/014287 | 1/2021 |
| WO | WO2021/018740 | 2/2021 |
| WO | WO2021/018772 | 2/2021 |
| WO | WO2021/018775 | 2/2021 |
| WO | WO2021/019419 | 2/2021 |
| WO | WO2021/021095 | 2/2021 |
| WO | WO2021/053488 | 3/2021 |
| WO | WO2021/067412 | 4/2021 |
| WO | WO2021/068058 | 4/2021 |
| WO | WO2021/074726 | 4/2021 |
| WO | WO2021/074727 | 4/2021 |
| WO | WO2021/074728 | 4/2021 |
| WO | WO2021/080550 | 4/2021 |
| WO | WO2021/099323 | 5/2021 |
| WO | WO2021/099358 | 5/2021 |

OTHER PUBLICATIONS

International Search Report and Written Opinion for International Application No. PCT/US2020/049459, dated Dec. 8, 2020, 13 pages.

International Search Report and Written Opinion for International Application No. PCT/US2020/049453, dated Dec. 14, 2020, 13 pages.

* cited by examiner

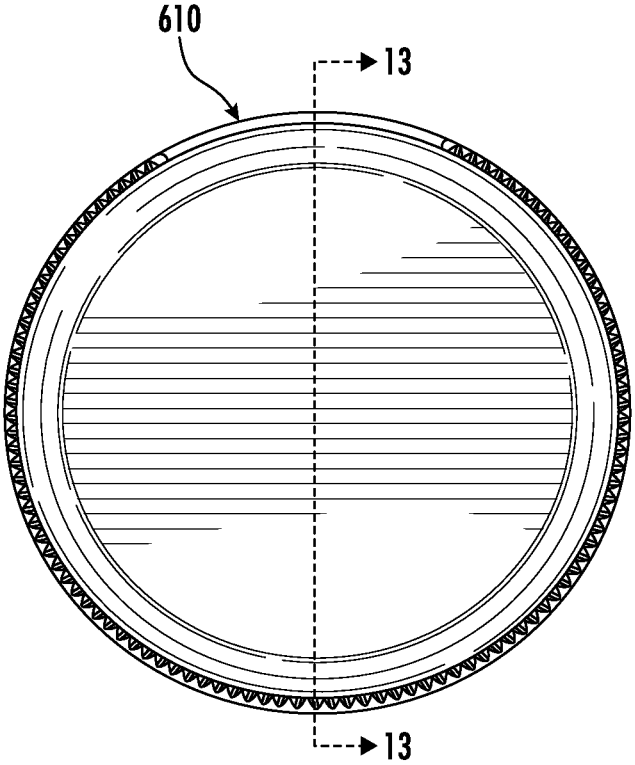
FIG. 12
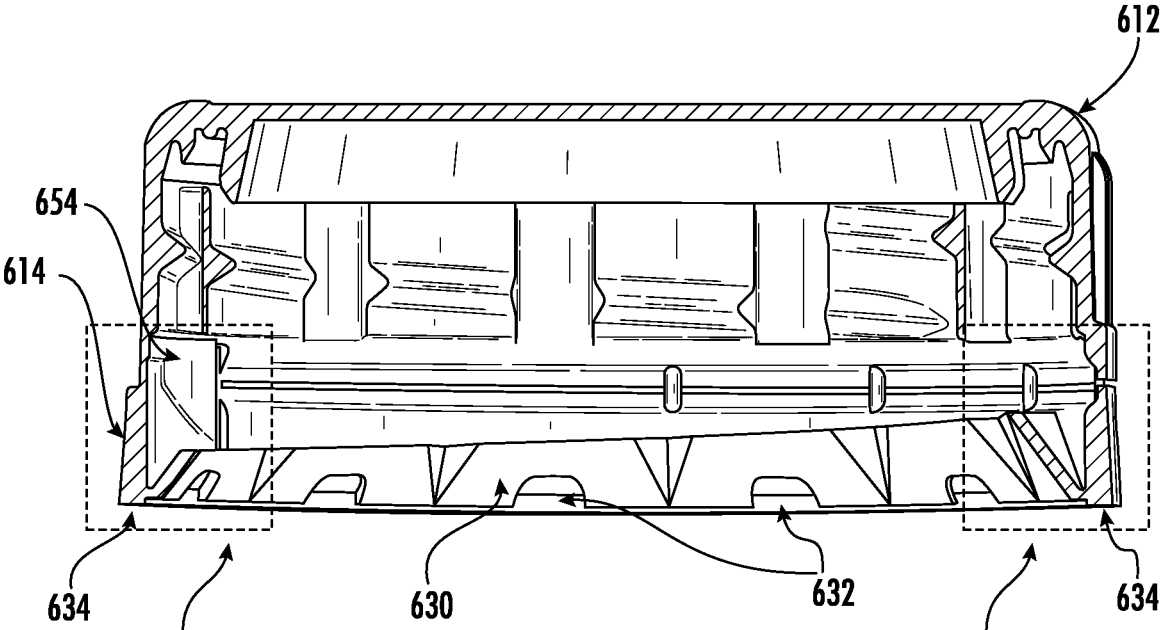
FIG. 14
FIG. 13
FIG. 15

TETHERED, HINGED CLOSURE

CROSS-REFERENCE TO RELATED PATENT APPLICATIONS

The present application is a continuation of International Application No. PCT/US2020/049453, filed Sep. 4, 2020, which claims the benefit of and priority to U.S. Application No. 62/900,917, filed Sep. 16, 2019, U.S. Application No. 62/897,005, filed Sep. 6, 2019, and U.S. Application No. 63/004,184, filed Apr. 2, 2020, and U.S. Application No. 63/023,543, filed May 12, 2020, each of which are incorporated herein by reference in their entirety.

BACKGROUND OF THE INVENTION

The present disclosure relates generally to the field of closures for containers. The present disclosure relates specifically to a closure for a container having a cap tethered to a retention band that remains coupled to a container even after the closure is opened.

SUMMARY OF THE INVENTION

According to one embodiment, this disclosure relates to a closure for a container, the closure including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, the retention band attached to the cylindrical wall by a plurality of frangible members, the frangible members providing a visual indication, when broken, that the closure has been opened, a first line of weakness that separates the cylindrical wall and the retention band, the plurality of frangible members extending across the line of weakness and connecting the cylindrical wall and the retention band, the first line of weakness extending circumferentially around the closure from a first end to a second end, a second line of weakness, which may or may not include frangible connections, that extends circumferentially around the closure, the second line of weakness being located closer to the top panel than the first line of weakness, a hinge defined between the first end and the second end of the first line of weakness, wherein the cylindrical wall pivots with respect to the retention band around the hinge, a first tether that maintains a coupling between the cylindrical wall and the retention band when the closure is opened, and a second tether that maintains a coupling between the cylindrical wall and the retention band when the closure is opened.

In a specific embodiment, the first tether extends away from the hinge to the cylindrical wall. In a specific embodiment, the second tether extends away from the hinge to the cylindrical wall. In a specific embodiment, the first tether and second tether extend in opposing directions away from the hinge. In a specific embodiment, the second line of weakness does not include any frangible connections. In a specific embodiment, the closure includes an interference band that extends from the retention band inwardly towards the rotational axis, the interference band extending a first length from a base of the retention band at a first location beneath the tab, and the interference band extending a second length from the base of the retention band at a second location, the second location being opposite the first location with respect to the rotational axis, and the second length being greater than the first length. In a specific embodiment, the first length is less than 75% of a third length from a bottom of the retention band to a top of the retention band. In a specific embodiment, the first length is less than 50% of a third length from a bottom of the retention band to a top of the retention band.

According to another embodiment, this disclosure relates to a closure including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, the retention band attached to the cylindrical wall by a plurality of frangible members, the frangible members providing a visual indication, when broken, that the closure has been opened, a first line of weakness that separates the cylindrical wall and the retention band, the plurality of frangible members extending across the line of weakness and connecting the cylindrical wall and the retention band, the first line of weakness extending circumferentially around the closure from a first end to a second end, a second line of weakness, which may or may not include frangible connections, that extends circumferentially around the closure, the second line of weakness being located further from the top panel than the first line of weakness, a hinge defined between the first end and the second end of the first line of weakness, the cylindrical wall pivoting with respect to the retention band around the hinge, a first tether that maintains a coupling between the cylindrical wall and the retention band when the closure is opened, and a second tether that maintains a coupling between the cylindrical wall and the retention band when the closure is opened.

In a specific embodiment, the first tether extends away from the hinge to the cylindrical wall. In a specific embodiment, the second tether extends away from the hinge to the cylindrical wall. In a specific embodiment, the first tether and second tether extend in opposing directions away from the hinge. In a specific embodiment, the second line of weakness does not include any frangible connections. In a specific embodiment, the closure includes an interference band that extends from the retention band inwardly towards the rotational axis, the interference band extending a first length from a base of the retention band at a first location beneath the hinge, and the interference banding a second length from the base of the retention band at a second location, the second location being opposite the first location with respect to the rotational axis, and the second length being greater than the first length. In a specific embodiment, the first length is less than 75% of a third length from a bottom of the retention band to a top of the retention band.

According to yet another embodiment, this disclosure relates to a closure including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, the retention band attached to the cylindrical wall by a plurality of frangible members, the frangible members providing a visual indication, when broken, that the closure has been opened, a first line of weakness that separates the cylindrical wall and the retention band, the plurality of frangible members extending across the line of weakness and connecting the cylindrical wall and the retention band, the first line of weakness extending circumferentially around the closure from a first end to a second end, a second line of weakness, which may or may not include frangible connections, that extends circumferentially around the closure, the second line of weakness being located closer to the top panel than the first line of weakness, the second line of weakness extending a circumferential length around the closure at least twice as far as a circumferential length between the first end and the second end of the first line of weakness, a hinge defined between the first end and the second end of the first line of weakness, the cylindrical wall pivoting with respect to the retention band around the hinge, a first tether that maintains a coupling between the cylindrical wall and the retention band when the closure is opened, and a second tether that maintains a coupling between the cylindrical wall and the retention band when the closure is opened.

In a specific embodiment, the first tether and second tether extend in opposing directions away from the hinge. In a specific embodiment, the second line of weakness does not include any frangible connections. In a specific embodiment, the second line of weakness includes at least one frangible connection. In a specific embodiment, the closure includes an interference band that extending from the retention band inwardly towards the rotational axis, the interference band extends a first length from a base of the retention band at a first location beneath the tab, and the interference band extending a second length from the base of the retention band at a second location, the second location being opposite the first location with respect to the rotational axis, and the second length being greater than the first length.

According to another embodiment, this disclosure relates to a closure for a container including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, a first line of weakness that separates the cylindrical wall and the retention band, the first line of weakness extending circumferentially around the closure from a first end to a second end, a second line of weakness that extends circumferentially around the closure, the second line of weakness being located closer to the top panel than the first line of weakness, a hinge defined between the first end and the second end of the first line of weakness, a first tether that maintains a coupling between the cylindrical wall and the retention band when the closure is opened, and a second tether that maintains a coupling between the cylindrical wall and the retention band when the closure is opened. The retention band is attached to the cylindrical wall by a plurality of frangible members. The frangible members provide a visual indication, when broken, that the closure has been opened. The plurality of frangible members extend across the line of weakness and connect the cylindrical wall and the retention band, and the cylindrical wall pivots with respect to the retention band around the hinge.

According to yet another embodiment, this disclosure relates to a closure for a container including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, the retention band attached to the cylindrical wall by a plurality of frangible members, the frangible members providing a visual indication, when broken, that the closure has been opened. The closure also includes a first line of weakness that separates the cylindrical wall and the retention band, the plurality of frangible members extending across the line of weakness to connect the cylindrical wall and the retention band, the first line of weakness extending circumferentially around the closure from a first end to a second end, a second line of weakness that extends circumferentially around the closure, the second line of weakness being located further from the top panel than the first line of weakness, a hinge defined between the first end and the second end of the first line of weakness, the cylindrical wall pivoting with respect to the retention band around the hinge, a first tether that maintains a coupling between the cylindrical wall and the retention band when the closure is opened, and a second tether that maintains a coupling between the cylindrical wall and the retention band when the closure is opened.

According to yet another embodiment, this disclosure relates to a closure for a container including a top panel including an upper surface and a lower surface, a rotational axis about which the top panel is centered, a cylindrical wall extending from the lower surface of the top panel, an inner surface of the cylindrical wall facing towards the rotational axis, a retention band pivotally coupled to the cylindrical wall, the retention band attached to the cylindrical wall by a plurality of frangible members, the frangible members providing a visual indication, when broken, that the closure has been opened, a first line of weakness that separates the cylindrical wall and the retention band, the plurality of frangible members extending across the line of weakness and connecting the cylindrical wall and the retention band, the first line of weakness extending circumferentially around the closure from a first end to a second end, a second line of weakness that extends circumferentially around the closure, the second line of weakness being located closer to the top panel than the first line of weakness, wherein the second line of weakness extends a circumferential length around the closure at least twice as far as a circumferential length between the first end and the second end of the first line of weakness, a hinge defined between the first end and the second end of the first line of weakness, the cylindrical wall pivoting with respect to the retention band around the hinge, a first tether that maintains a coupling between the cylindrical wall and the retention band when the closure is opened, and a second tether that maintains a coupling between the cylindrical wall and the retention band when the closure is opened.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

BRIEF DESCRIPTION OF THE DRAWINGS

FIG. 12 is a top view of a closure, according to an exemplary embodiment.

FIG. 13 is a cross-section view of the closure of FIG. 12 taken along line 13-13 in FIG. 12.

DETAILED DESCRIPTION

Figure 1:
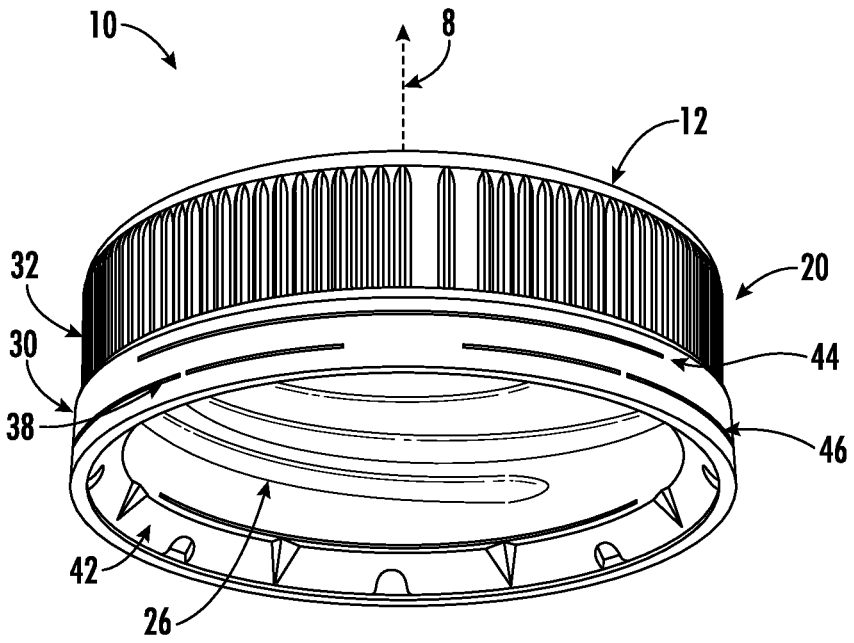
FIG. 1 is a perspective view of a closure, according to an exemplary embodiment.
Figure 2:
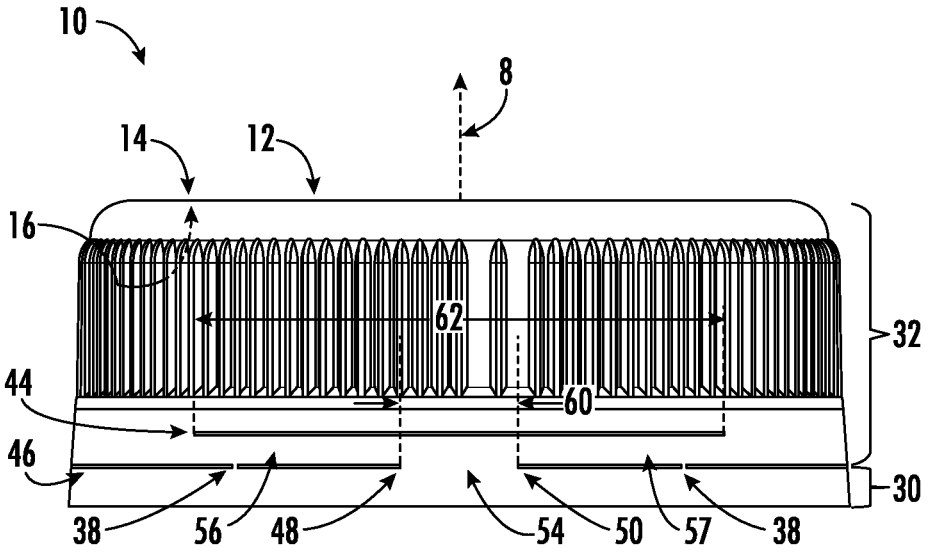
FIG. 2 is a back view of the closure of FIG. 1, according to an exemplary embodiment.
Figure 3:
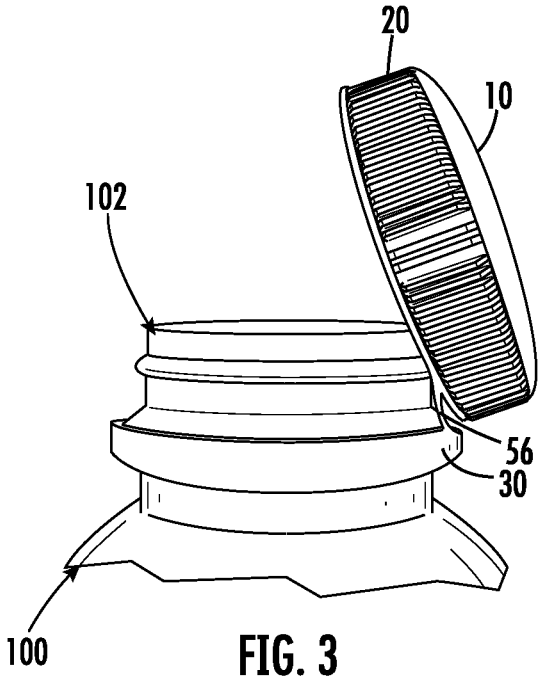
FIG. 3 is a perspective view of the closure of FIG. 1 on a container, according to an exemplary embodiment.

Turning to FIG. 1, a closure 10 is shown according to an exemplary embodiment. Closure 10 includes an end wall or top portion, shown as a top panel 12. Top panel 12 is generally circular in shape and is generally planar (i.e., the outer surface of top panel 12 is flat and positioned substantially in a single plane) and is centered around rotational axis 8. Closure 10 includes a sidewall, shown as skirt 20, that extends downwardly from a bottom surface 16 at a periphery of top panel 12. Upper surface 14 of top panel 12 faces upwards and away from bottom surface 16.

Skirt 20 is generally annular in cross-section and is substantially perpendicular to the plane defined by top panel 12. As shown in FIG. 1, closure 10 may also optionally include a plurality of raised ribs extending radially outward from an outer surface of skirt 20. As shown in FIG. 1, the ribs may extend vertically along at least a portion of the vertical length of the outer surface of skirt 20 to provide a textured or gripping surface that may facilitate opening of closure 10.

Located along the inner surface of the skirt 20 is a container engagement structure, shown as threading 26, configured to interact with a corresponding closure engagement structure located on the neck 102 of the container 100 to which closure 10 is to be sealingly applied. Threading 26 extends inwardly from the inner surface of skirt 20. Threading 26 is configured to engage corresponding threading present on the container 100 to which closure 10 is attached. In various other embodiments, closure 10 may include any other number of types of engagement structures, such as but not limited to snap beads, lugs, etc.

In some embodiments, closure 10 may further include a tamper evidencing structure, such as frangible connections 38, configured to provide visual indication to a user that the initial sealing engagement between closure 10 and the container 100 has been disrupted as a result of the closure 10 being partially or entirely opened. In one embodiment the frangible connections 38 couple body 32 of closure 10 to retention band 30. Upon application of twisting force to closure 10 to remove closure 10 from a container 100, a majority if not all frangible connections 38 are configured to break, separating body 32 from retention band 30 except for an intervening connection, such as first tether 56 and second tether 57.

In a specific embodiment, closure 10 includes an interfacing structure, shown as J-Band 42, that engages cooperating structures on the neck of the container to prevent closure 10 from being removed from the container without a majority and/or all of frangible connections 38 breaking.

Closure 10 includes two lines of weakness, shown as a first line of weakness 44 and a second line of weakness 46, that extend circumferentially around closure 10. In one embodiment, both first line of weakness 44 and second line of weakness 46 include frangible connections 38 that break when closure 10 is opened. In another embodiment, first line of weakness 44 includes frangible connections 38 that break when closure 10 is opened, and second line of weakness 46 does not include frangible connections.

First line of weakness 44 extends circumferentially from a first end 48 to a second end 50. First end 48 and second end 50 are separated by circumferential distance 60, with respect to axis 8. In a specific embodiment, distance 60 is between 10 degrees and 45 degrees, and more specifically is between 15 degrees and 35 degrees.

A hinge 54 is located between first end 48 and second end 50. Skirt 20 cylindrical wall pivots with respect to retention band 30 around the hinge 54. First line of weakness 44 separates skirt 20 from retention band 30. A plurality of frangible connections 38 extend across first line of weakness 44 to couple body 32 of closure 10 to retention band 30. Second line of weakness 46 is closer to top panel 12 than first line of weakness. Second line of weakness 46 extends circumferential distance 62 around closure with respect to axis 8. In a specific embodiment, distance 62 is between 60 degrees and 150 degrees, and more specifically is between 90 degrees and 120 degrees.

When the container 100 that closure 10 is coupled to is oriented in a typical upright position, top panel 12 is substantially horizontal to a ground surface and skirt 20 is generally vertical with respect to the ground. First line of weakness 44 circumferentially surrounds closure 10 at a substantially consistent distance from top panel 12. Second line of weakness 46 partially circumferentially surrounds closure 10 a substantially consistent second distance from top panel 12 that is less than the distance of the upper line of weakness 44. In this arrangement, first line of weakness 44 and second line of weakness 46 are substantially parallel to each other. In various embodiments, frangible connections 38 are disposed periodically throughout one or more of first and second lines of weakness 44, 46, such as approximately every 20 degrees of arc from the perspective of center axis 8 of closure 10.

First and second tethers 56, 57 are sturdier than frangible connections 38 and therefore less likely to break when closure 10 is being opened. As a result, often first and second tethers 56, 57 remain unbroken and therefore body 32 of closure 10, which includes top panel 12 and skirt 20, remains coupled to retention band 30 via first and second tethers 56, 57. One or more of tethers 56, 57 (e.g., one or more of first tether 56 and second tether 57) extend in opposing directions away from hinge 54 towards body 32 of closure 10.

When closure 10 is opened with respect to container 100, body 32 pivots with respect to the container neck around hinge 54, the inlet of the container 100 is uncovered, and the contents of the container 100 (e.g., water) may be consumed, removed, etc.

Subsequent to a user removing the contents of the container 100, body 32 of closure 10 may be re-coupled to the inlet of the container 100. Skirt 20 is positioned above container inlet 102 and rotated to engage threading 26 with the outer surface of the container inlet 102 (e.g., by rotating sidewall clockwise from a perspective above top panel 12).

Figure 4:
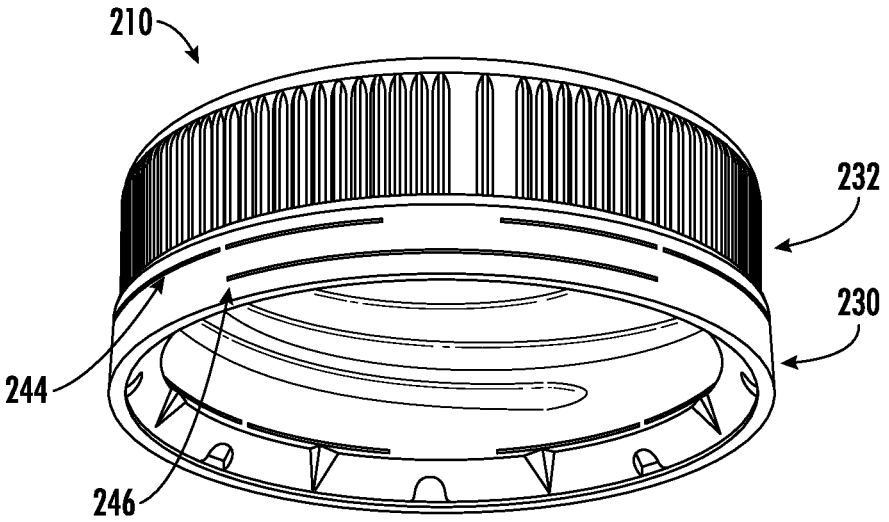
FIG. 4 is a perspective view from below of a closure, according to an exemplary embodiment.
Figure 5:
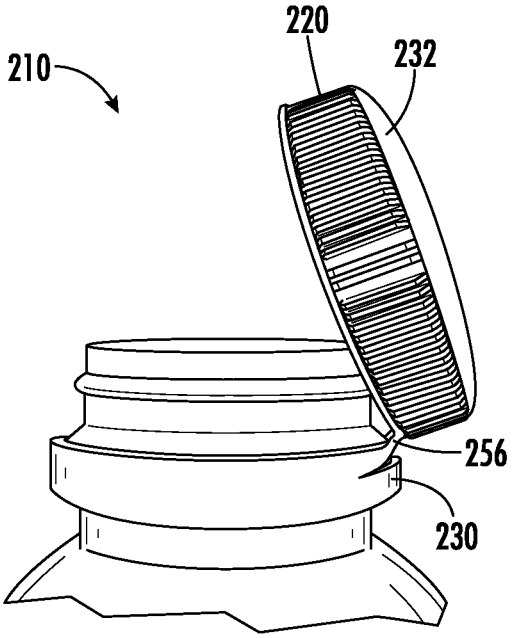
FIG. 5 is a perspective view of the closure of FIG. 4 on a container, according to an exemplary embodiment.

FIGS. 4-5 depict various aspects of closure 210. Closure 210 is similar to closure 10 except as described herein. Closure includes first line of weakness 244 and second line of weakness 246. The lines of weakness in closure 210 are similar to the lines of weakness in closure 10, except that their respective arrangement is reversed so that first line of weakness 244 is above second line of weakness 246 in closure 210. Skirt 220 and body 232 are separated from retention band 230 by first line of weakness 244.

Figure 6:
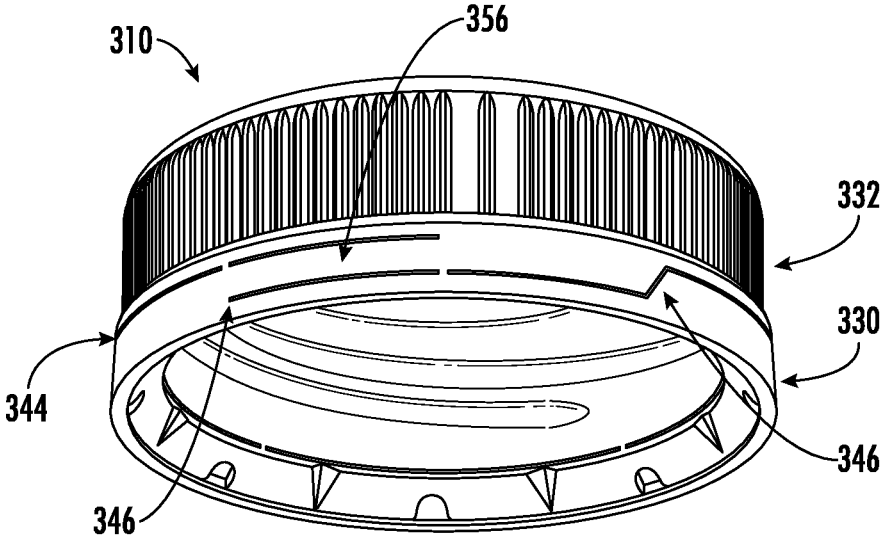
FIG. 6 is a perspective view from below of a closure, according to an exemplary embodiment.
Figure 7:
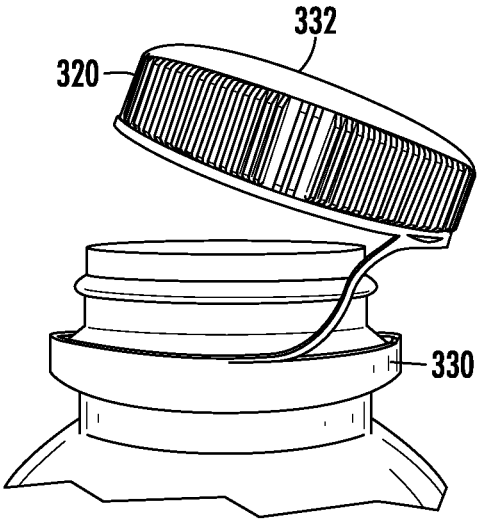
FIG. 7 is a perspective view of the closure of FIG. 6 on a container, according to an exemplary embodiment.

FIGS. 6-7 depict various aspects of closure 310. Closure 310 is similar to closure 10 except as described herein. Body 332 and skirt 320 are separated from retention band 330 by first line of weakness 344. Second line of weakness 346 extends diagonally from first line of weakness 344 before extending circumferentially around closure 310 beneath first line of weakness 344. Tether 356 is formed between first line of weakness 344 and second line of weakness 346. Skirt 320 and body 332 are separated from retention band 330 by first line of weakness 344.

Figure 8:
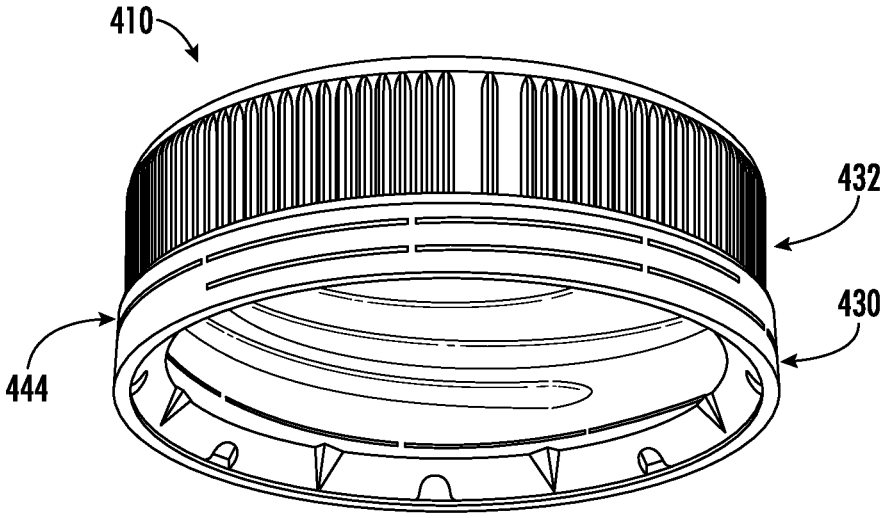
FIG. 8 is a perspective view from below of a closure, according to an exemplary embodiment.
Figure 9:
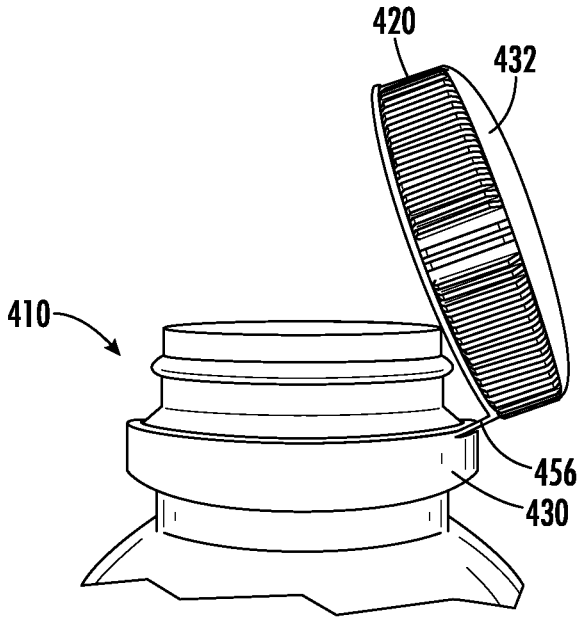
FIG. 9 is a perspective view of the closure of FIG. 8 on a container, according to an exemplary embodiment.

FIGS. 8-9 depict various aspects of closure 410. Closure 410 is similar to closure 10 except as described herein. First line of weakness 444 extends helically around closure 410 such that a tether 456 is formed between first line of weakness 444 (best shown FIG. 8). First line of weakness 444 separates body 432 and skirt 420 from retention band 430. In a specific embodiment first line of weakness 444 extends between 405 and 495 degrees around closure 410 with respect to the rotational axis of closure 410, and more specifically first line of weakness 444 extends 450 degrees around closure 410.

Figure 10:
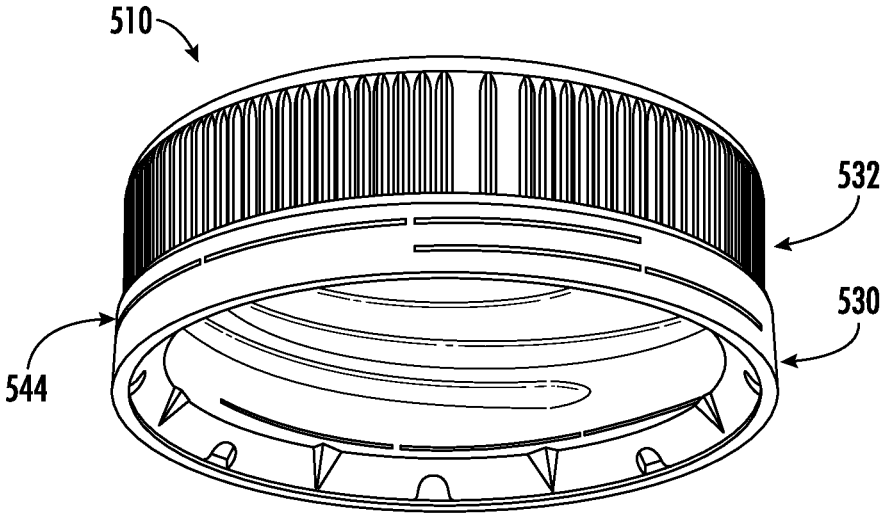
FIG. 10 is a perspective view from below of a closure, according to an exemplary embodiment.
Figure 11:
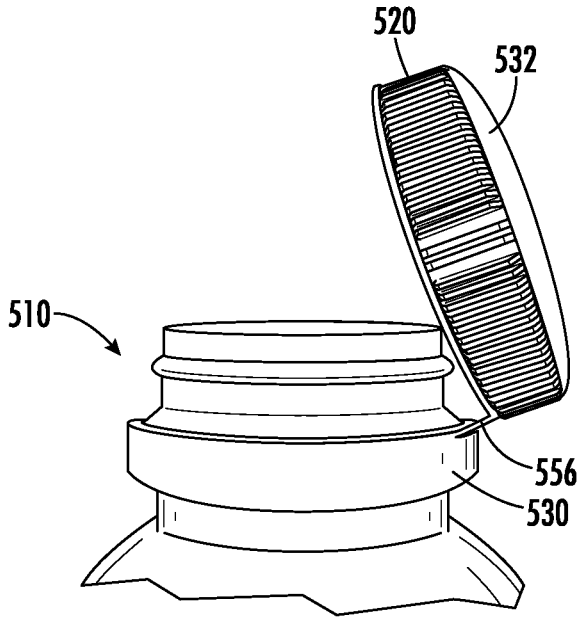
FIG. 11 is a perspective view of the closure of FIG. 10 on a container, according to an exemplary embodiment.
Figure 14:
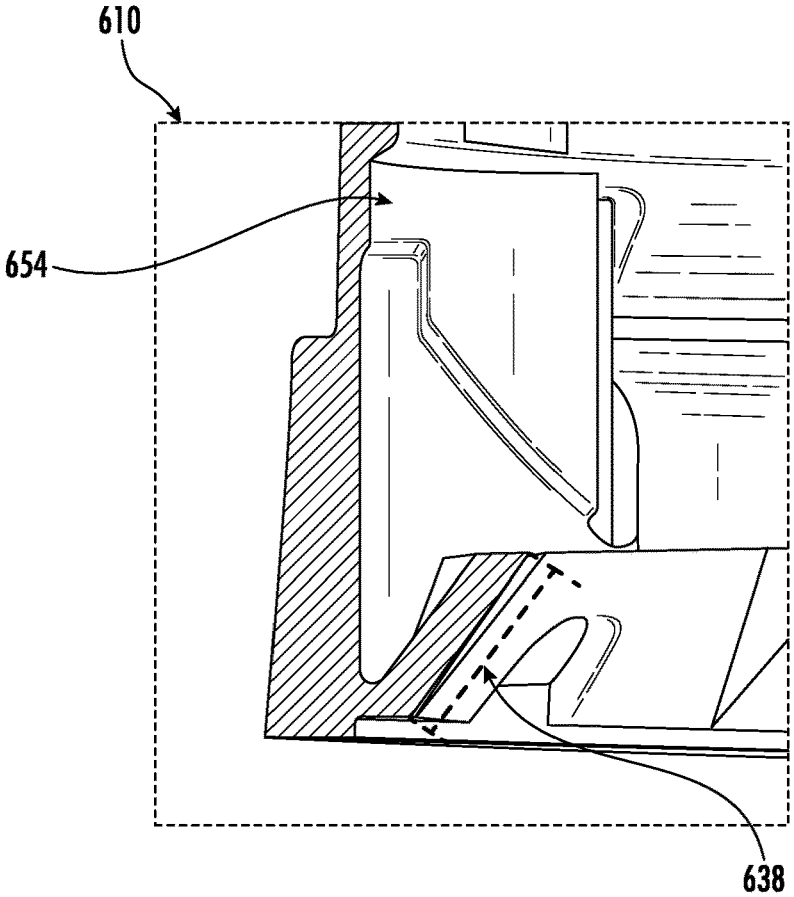
FIG. 14 is a detailed cross-section view of a portion of the closure of FIG. 12 taken along line 13-13 in FIG. 12.
Figure 15:
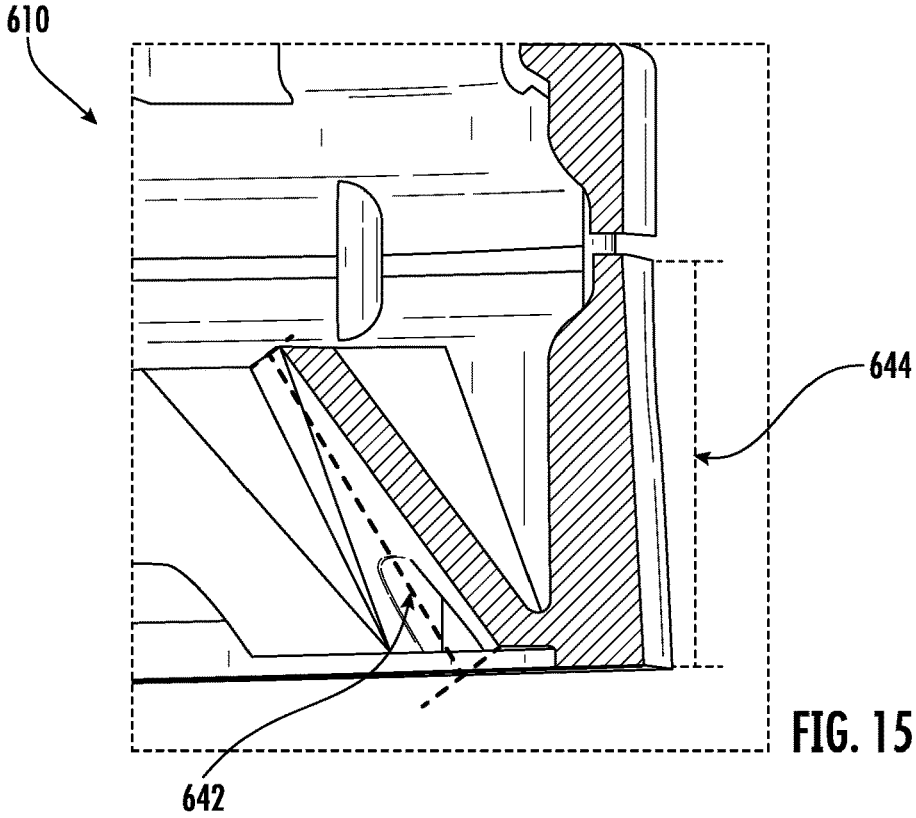
FIG. 15 is a detailed cross-section view of a portion of the closure of FIG. 12 taken along line 13-13 in FIG. 12.

FIGS. 10-11 depict various aspects of closure 510. Closure 510 is similar to closure 10 and especially closure 410 except as described herein. First line of weakness 544 extends helically around closure 510 such that a tether 556 is formed between first line of weakness 544 (best shown FIG. 10). First line of weakness 544 separates body 532 and skirt 520 from retention band 530. In a specific embodiment first line of weakness 544 extends between 380 and 420 degrees around closure 510 with respect to the rotational axis of closure 510, and more specifically first line of weakness 444 extends 400 degrees around closure 510.

Turning to FIGS. 12-15, various aspects of closure 610 and retaining band 614 are shown. Closure 610 is similar to closure 10 and the other closures except as described herein. Similarly, retaining band 614 in closure 610 is similar to retaining band 30 in closure 10 except as described herein. It is contemplated herein that retaining band 614 may be incorporated with any of the closures described herein.

Interference band 630 extends from retaining band 614 towards top panel 612 and includes a tapered formation that facilitates the body of the closure pivoting away from interference band 630, particularly when the closure includes a tethered formation that couples the body of the closure to the retaining band. Interference band 630 extends inwards from base 634 of retention band 614. Interference band 630 includes one or more apertures 632.

Interference band 630 extends a varying distance from base 634 at different circumferential positions with respect to axis 8. At the one or more locations below hinge 654 (see FIG. 14), interference band 630 has length 638. At the one or more locations opposite hinge 654 with respect to rotational axis 8 (see FIG. 15), interference band 630 has length 642, which is longer than length 638. In a specific embodiment, base 634 defines distance 644 between top of retaining band 614 at the weakened section, shown as line of weakness 634, and base 634 of retention band 614. In a specific embodiment, length 638 is less than 75% of length 642, and more specifically less than 60% of length 642, and even more specifically length 138 is less than 50% of distance 644.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure for a container comprising:

a top panel including an upper surface and a lower surface;

a rotational axis about which the top panel is centered;

a cylindrical wall extending from the lower surface of the top panel;

an inner surface of the cylindrical wall facing towards the rotational axis;

a retention band pivotally coupled to the cylindrical wall, the retention band attached to the cylindrical wall by a plurality of frangible members, the frangible members providing a visual indication, when broken, that the closure has been opened;

a first line of weakness that separates the cylindrical wall and the retention band, wherein the plurality of frangible members extend across the line of weakness and connect the cylindrical wall and the retention band, the first line of weakness extending circumferentially around the closure from a first end to a second end;

a second line of weakness that extends circumferentially around the closure, the second line of weakness being located further from the top panel than the first line of weakness;

a hinge defined between the first end and the second end of the first line of weakness, wherein the cylindrical wall pivots with respect to the retention band around the hinge;

a first tether that maintains a coupling between the cylindrical wall and the retention band when the closure is opened;

a second tether that maintains a coupling between the cylindrical wall and the retention band when the closure is opened; and an interference band that extends from the retention band inwardly towards the rotational axis, the interference band extends a first length from a base of the retention band at a first location beneath the hinge, and the interference band extends a second length from the base of the retention band at a second location, wherein the second location is opposite the first location with respect to the rotational axis, and wherein the second length is greater than the first length, wherein the interference band extends a third length from the base of the retention band at a third location that is circumferentially halfway between the first location and the second location, wherein the difference between the first length and the third length is the same as the difference between the second length and the third length.

2. The closure of claim 1, wherein the first tether extends away from the hinge to the cylindrical wall.

3. The closure of claim 2, wherein the second tether extends away from the hinge to the cylindrical wall.

4. The closure of claim 1, wherein the first tether and second tether extend in opposing directions away from the hinge.

5. The closure of claim 1, wherein the second line of weakness does not include any frangible connections.

6. The closure of claim 1, wherein the first length is less than 75% of a third length from a bottom of the retention band to a top of the retention band.

7. The closure of claim 1, wherein the first length is less than 50% of a third length from a bottom of the retention band to a top of the retention band.

8. A closure for a container comprising:

a top panel including an upper surface and a lower surface;

a rotational axis about which the top panel is centered;

a cylindrical wall extending from the lower surface of the top panel;

an inner surface of the cylindrical wall facing towards the rotational axis;

a retention band pivotally coupled to the cylindrical wall, the retention band attached to the cylindrical wall by a plurality of frangible members, the frangible members providing a visual indication, when broken, that the closure has been opened;

a first line of weakness that separates the cylindrical wall and the retention band, wherein the plurality of frangible members extend across the line of weakness and connect the cylindrical wall and the retention band, the first line of weakness extending circumferentially around the closure from a first end to a second end;

a second line of weakness that extends circumferentially around the closure, the second line of weakness being located further from the top panel than the first line of weakness;

a hinge defined between the first end and the second end of the first line of weakness, wherein the cylindrical wall pivots with respect to the retention band around the hinge;

a first tether that maintains a coupling between the cylindrical wall and the retention band when the closure is opened;

a second tether that maintains a coupling between the cylindrical wall and the retention band when the closure is opened; and an interference band that extends from the retention band inwardly towards the rotational axis, the interference band extends a first length from a base of the retention band at a first location beneath the hinge, and the interference band extends a second length from the base of the retention band at a second location, wherein the second location is opposite the first location with respect to the rotational axis, and wherein the second length is greater than the first length, wherein the length of the interference band increases linearly between the first location and the second location.

9. The closure of claim 8, wherein the first tether extends away from the hinge to the cylindrical wall.

10. The closure of claim 9, wherein the second tether extends away from the hinge to the cylindrical wall.

11. The closure of claim 8, wherein the first tether and second tether extend in opposing directions away from the hinge.

12. The closure of claim 9, wherein the second line of weakness does not include any frangible connections.

13. The closure of claim 8, wherein the first length is less than 75% of a third length from a bottom of the retention band to a top of the retention band.

14. A closure for a container comprising:

a top panel including an upper surface and a lower surface;

a rotational axis about which the top panel is centered;

a cylindrical wall extending from the lower surface of the top panel;

an inner surface of the cylindrical wall facing towards the rotational axis;

a retention band pivotally coupled to the cylindrical wall, the retention band attached to the cylindrical wall by a plurality of frangible members, the frangible members providing a visual indication, when broken, that the closure has been opened;

a first line of weakness that separates the cylindrical wall and the retention band, wherein the plurality of frangible members extend across the line of weakness and connect the cylindrical wall and the retention band, the first line of weakness extending circumferentially around the closure from a first end to a second end;

a second line of weakness that extends circumferentially around the closure, the second line of weakness being located further from the top panel than the first line of weakness, wherein the second line of weakness extends a circumferential length around the closure at least twice as far as a circumferential length between the first end and the second end of the first line of weakness;

a hinge defined between the first end and the second end of the first line of weakness, wherein the cylindrical wall pivots with respect to the retention band around the hinge;

a first tether that maintains a coupling between the cylindrical wall and the retention band when the closure is opened; and a second tether that maintains a coupling between the cylindrical wall and the retention band when the closure is opened; and an interference band that extends from the retention band inwardly towards the rotational axis, the interference band extends a first length from a base of the retention band at a first location beneath the hinge, and the interference band extends a second length from the base of the retention band at a second location, wherein the second location is opposite the first location with respect to the rotational axis, and wherein the second length is greater than the first length, wherein the length of the interference band increases continuously between the first location and the second location.

15. The closure of claim 14, wherein the first tether and second tether extend in opposing directions away from the hinge.

16. The closure of claim 14, wherein the second line of weakness does not include any frangible connections.

17. The closure of claim 14, wherein the second line of weakness includes at least one frangible connection.

* * * * *